US005421669A

United States Patent [19]

Bertrand

[11] Patent Number: 5,421,669

[45] Date of Patent: Jun. 6, 1995

[54] MACHINE FOR MAKING ROAD MARKER-RECEIVING CAVITIES IN A ROADWAY SURFACE

[76] Inventor: René Bertrand, 760 Rossiter, St-Jean-sur-Richelieu Quebec, Canada, J3B 8J1

[21] Appl. No.: 131,384

[22] Filed: Oct. 5, 1993

[51] Int. Cl.[6] ..... E01F 9/087; E01C 23/088

[52] U.S. Cl. ..... 404/90; 299/39

[58] Field of Search ..... 404/15, 16, 72, 75, 404/90, 93, 94; 299/38, 39, 49, 50

[56] References Cited

U.S. PATENT DOCUMENTS

| | | | |
|---|---|---|---|
| 4,147,447 | 4/1979 | Heenan et al. | 404/16 |
| 4,174,184 | 11/1979 | Hennan | 404/72 |
| 4,195,945 | 11/1980 | Heenan | 404/16 |
| 4,797,025 | 1/1989 | Kennedy | 404/90 |
| 4,832,412 | 5/1989 | Bertrand | 299/39 |
| 5,230,270 | 4/1993 | Bertrand | 83/489 |

*Primary Examiner*—David J. Bagnell

*Assistant Examiner*—Pamela A. O'Connor

*Attorney, Agent, or Firm*—Robic

[57] ABSTRACT

Disclosed is a machine for making cavities in a roadway surface so as to install road markers which is particularly well adapted to make the required cavities in a very speedy and efficient manner, thereby reducing to the lowest extent the risk of traffic jams when the road markers are to be installed on a busy road or highway. The machine is part of a vehicle that can be driven along the road or the highway where the road markers are to be installed. It incudes a cutting device that can be moved laterally away from the vehicle up to the desired location, and then pressed downwardly after having been suitable adjusted to be properly levelled with the roadway surface. Such positioning and operation of the cutting device can be easily carried out by the driver of the vehicle from his or her cabin, thereby making the required cutting and subsequent installation of the road markers very fast to complete.

18 Claims, 8 Drawing Sheets

MACHINE FOR MAKING ROAD MARKER-RECEIVING CAVITIES IN A ROADWAY SURFACE

BACKGROUND OF THE INVENTION a) field of the invention

The present invention relates to a machine for making cavities in a roadway surface so as to install road markers on this roadway surface.

More particularly, the invention relates to a machine of the above type, which is mounted on a support base forming part of a powered vehicle that can be driven on the roadway surface where the road markers are to be installed.

b) brief description of the prior art

It is of conventional practice, especially in foggy countries, to install road markers (also known as "road reflectors" or "cat-eyes") on the roadway surfaces, so as to mark the traffic line(s). These markers are preferably used as a "complement" to the painted traffic lines, and comprise signal means whose purpose is to give a visible signal to the driver of an oncoming vehicle. Such signal means preferably consist of light reflectors that reflects the light emanating from the oncoming vehicle, eventhough, under certain circumstances, other non-passive means such as electric lamps, may also be used.

In countries like Canada or the upper part of the United States, which are subject to heavy snow storms in winter, road markers have been devised, which are so constructed as not to be torn out of the road surface by the blades of the snow plows that are used to remove the snow. An example of such a snow plowable road marker is disclosed in U.S. Pat. Nos. 4,147,447 and 4,195,945 both granted to AMERACE CORPORATION. The way this know marker can be installed, is disclosed in U.S. Pat. No. 4,174,184 granted to the same company. Other examples of snow plowable road markers are disclosed in the prior art references listed in the preamble of these U.S. patents.

In short, the road marker patented by AMERACE CORPORATION can be disclosed as comprising two keel-shaped members laterally spaced apart and adapted to be respectively disposed and secured by gluing or otherwise, in a pair of complementary, arcuate recesses made in the roadway surface. The marker also comprises a bracing member interconnecting the keel-shaped members, which is adapted to be disposed in a complementary arcuate recess made in the roadway surface. This bracing member supports a reflector which does not project upwardly out of the plane defined by the upper surfaces of the keel-shaped thus members, so as to be protected by the same and not to be torn out by a snow plow. This reflector is of course devised and positioned in between the keel-shaped members so as to be visible to an oncoming vehicle.

In U.S. Pat. No. 4,174,184, an apparatus is disclosed, for use to cut the set of recesses required to install the road markers disclosed hereinabove into a roadway surface,. The apparatus includes a plurality of circular blades mounted on a same shaft which is itself mounted on the frame of a wheeled cart that must be towed on the premises where the recesses are to be cut, and then be manually adjusted. If this apparatus is very efficient, the way it is devised and it operates makes the installation of a plurality of road markers on a road or highway time consuming.

SUMMARY OF THE INVENTION

The object of the present invention is to provide a machine for making cavities in a roadway surface so as to install road markers like those disclosed hereinabove, which machine is particularly well adapted to make the required cavities in a very speedy and efficient manner, thereby reducing to the lowest extent the risk of traffic jams when the road markers are to be installed on a busy road or highway.

More particularly, the invention provides a machine for making a cavity in a roadway surface so as to install a road marker, which machine is operatively mounted on a support base forming part of a powered vehicle having a front-to-rear axis, like the platform of a truck which can move very fast over the roadway surface.

Basically, the machine according to the invention comprises:

a) a lengthwise-extensible boom having a longitudinal axis and an extensible end;

b) first mounting means for mounting the boom on the support base so that the boom extends substantially horizontally in a direction transversal to the front-to-rear axis of the vehicle;

c) power jack means having an extensible bottom end, these means preferably consisting of two hydraulic cylinders having housings rigidly connected in parallel relationship and piston rods movable in unison;

d) second mounting means for mounting the power jack means on the extensible end of the boom so that, on the one hand, the boom and powered jack means extends in a same vertical plane and, on the other hand, the power jack means is downwardly oriented and has its bottom end downwardly extensible, the second mounting means including means for adjustably tilting the power jack means within the vertical plane about an axis perpendicular to the boom;

e) a cutting device mounted at the bottom end of the power jack means so as to come into contact with the roadway surface and to make therein the required cavity when the power jack means is actuated;

f) first control means for ascertaining that the cutting device is properly oriented relative to the roadway surface prior to making the required cavity; and g) second control means for controlling the depth of penetration of the cutting device and thus the depth of the cavity while the same is being made, this second control means consisting of at least one and preferably more than one stops operatively associated to the extensible bottom end of the power jack means so as to contact the roadway surface and prevent the extensible bottom end and cutting device mounted on it from further moving down into the roadway surface as soon as the cavity is completed.

In accordance with a first preferred embodiment of the invention, the first control means comprises a pair of identical legs slidably mounted in parallel relationship onto a support secured to the extensible bottom end of the power jack means. These legs extend parallel to the power jack means in a plane parallel to the boom and have feet positioned to contact the roadway surface before or at the very same time as the cutting device when the power jack means is actuated. The legs also have upper ends devised to give a visible indication to an operator who can be the driver of the truck, that the legs extend at the same level and that, accordingly, the adjacent cutting device is properly levelled relative to the roadway surface.

This first control means is particularly well adapted to ascertain that the cutting device is properly oriented whatever be the shape and inclination of the roadway surface.

Preferably, each leg is mounted within a sleeve connected to the support and has its foot spring-biased downwards and its upper end bearing under one arm of an L-shaped member pivotably connected to the support about an axis parallel to the longitudinal axis. The L-shaped member has another, upwardly extending arm with an upper free end shaped to define an horizontal mark which is aligned with the similar mark of the other leg when the cutting device is properly levelled.

In accordance with another preferred embodiment of the invention, the first control means may also comprise means positioned to be visible to the driver of the truck, so as to ascertain that the power jack means is in a position perpendicular to the boom. These visual means preferably include a pin rigidly connected to the power jack means so as to extend towards and parallel to the boom, and a mark made onto the boom so as to face and be aligned with the pin when the power jack means and its pin are tilted and have reached the position where the power jack means is perpendicular to the boom.

This other first control means is very simple and efficient, but useful only when the roadway surface on which the vehicle is moving, is actually flat.

In accordance with a further preferred embodiment of the invention, the machine may further comprise third control means for rapidly ascertaining the position of the cutting device relative to the roadway surface. Advantageously, the third control means comprises:

- a rod projecting upwardly from the support of the legs in a direction parallel to the power jack means;
- a sleeve rigidly connected to the power jack means away from the extensible bottom end of the same and slidably engaged on the rod; and
- marks on the rod to give a visual indication of the longitudinal position of the rod and associated support relative to the sleeve and thus of the cutting device relative to the roadway surface.

The machine according to the invention is particularly well adapted to install snowplowable road markers as disclosed herein above, comprising two elongated keel-shaped members laterally spaced apart and adapted to be respectively disposed and secured in a pair of complementary recesses made in the roadway surface, the marker also comprising a bracing member interconnecting the keel-shaped members and supporting signal means devised and positioned to be visible from oncoming vehicles moving on the roadway surface. In such a case, the cutting device comprises:

- a shaft extending in the same plane as the boom and the power jack means in a direction substantially perpendicular to the power jack means;
- a power means to drive the shaft in rotation; and
- a set of circular blades mounted in parallel relationship onto the shaft so as to rotate therewith, the blades being sized and positioned so as to cut three arcuate recesses when the cutting device is operated, including two laterally spaced-apart recesses sized and positioned to receive the keel-shaped members and a central recess sized and positioned to receive the bracing member of the road marker, the three recesses forming the cavity to be made in the roadway surface.

As can now be appreciated, the machine according to the invention is part of a vehicle that can be driven along the road or the highway where road markers are to be installed. The machine includes a cutting device that can be moved laterally away from the vehicle up to the desired location, and then pressed downwardly after having been suitable adjusted to be properly levelled with the roadway surface. Such positioning and operation of the cutting device can be easily carried out by the driver of the vehicle from his or her cabin, thereby making the required cutting and subsequent installation of the road markers very fast to complete.

The invention and its advantages will be better understood upon reading the following non-restrictive description of a preferred embodiment thereof, given with reference to the accompanying drawings.

DESCRIPTION OF A PREFERRED EMBODIMENT OF THE INVENTION

Figure 8:
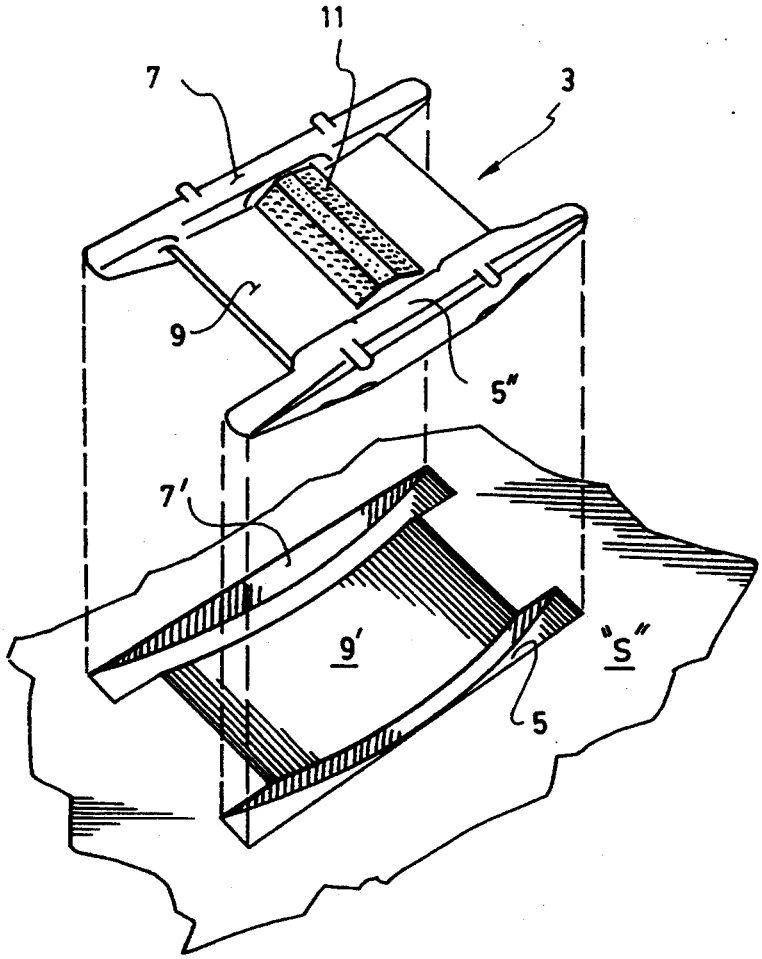
FIG. 8 is a perspective view of a road marker that can be installed with the machine shown in FIGS. 1 to 7, showing also its corresponding cavity.
Figure 9:
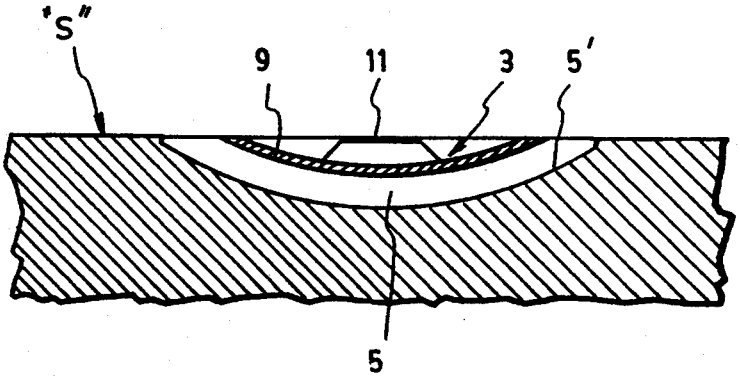
FIG. 9 is a cross-sectional side view of the road marker shown in FIG. 8, when installed in its corresponding cavity.

The machine 1 according to the invention as shown in the accompanying drawings is intended to be used for making cavities in a very efficient and fast manner in a roadway surface "S" so as to install road markers like the one numbered 3 in FIGS. 8 and 9, eventhough, with a few minor structural changes, it could also be used with the same efficiency to install any other kind of road markers.

As can be seen, the road marker 3 comprises two elongated keel-shaped members 5, 7 laterally spaced apart and adapted to be respectively disposed and secured in a pair of complementary recesses 5', 7' made in the roadway surface "S". The road marker 3 also comprises a bracing member 9 interconnecting the keel-shaped members. This member 9 is also adapted to be disposed and secured in a complementary recess 9' made the roadway surface. It supports signal means 11 such as a light reflector, which is devised and positioned to be visible from oncoming vehicles moving on the roadway surface. For further information as to the structure, operation and advantages of this road marker, reference can be made to U.S. Pat Nos. 4,147,447 and 4,195,945 mentioned hereinabove.

Figure 1:
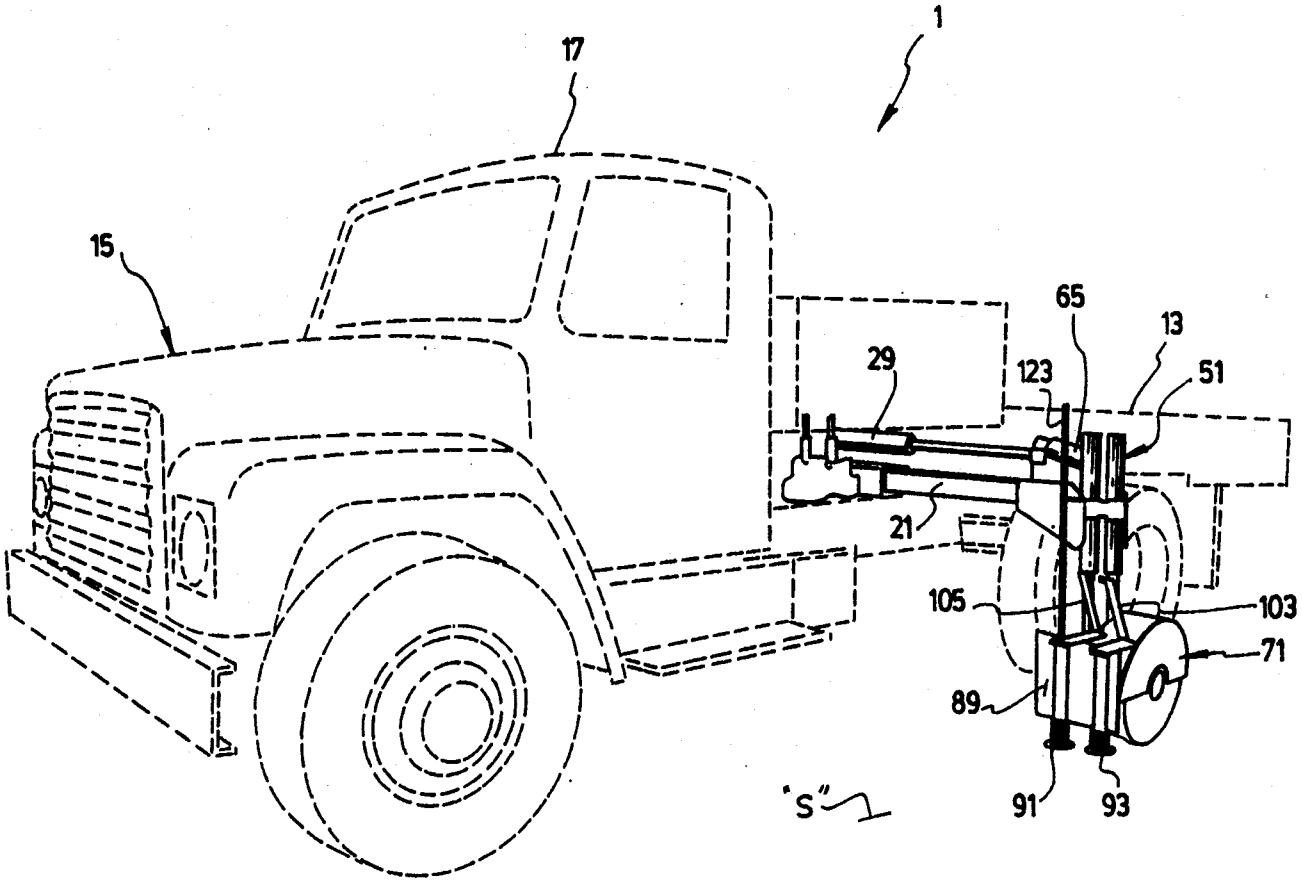
FIG. 1 is a perspective view of a machine according to the invention, for making road marker-receiving cavities, mounted on the rear platform of a truck.

The machine 1 for making the cavity required to install the road markers whose structure has just been disclosed, is mounted on a support base forming part of a powered vehicle having a front-to-rear axis. As is shown in FIG. 1, such the support base can be the rear platform 13 of a truck 15 provided with a front cabin 17.

As is better shown in FIGS. 2 to 5, the machine 1 comprises a lengthwise-extensible boom 21 having a longitudinal axis and an extensible end 23. The boom 21 is telescopic and includes an outer member 25, an inner member 27 slidably mounted within the outer member, and a power cylinder 29 which is preferably hydraulic, having one end connected to the outer member and another end connected to the inner member so as to adjustably move the inner member with respect to the outer member.

First mounting means are provided for mounting the boom 21 on the platform 13 so that this boom 21 extends substantially horizontally in a direction transversal to the front-to-rear axis of the truck 15. In the illustrated embodiment, the first mounting means comprises first and second guiding rails 31, 33 rigidly fixed to the platform 13. The rails are spaced apart and extend parallel to the front-to-rear axis of the truck. The first mounting means also comprises first and second boom carriers 35, 37 slidably mounted on the first and second rails, respectively. It further comprises first and second driving means 39, 41, preferably consisting of hydraulic cylinders, for moving the first and second carriers along the first and second rails independently from each other. Connecting means 43 are provided for pivotably connecting the outer member 25 onto any one of the carriers, for example the one numbered 35, about a first axis "A" perpendicular to the longitudinal axis of the boom 21. Holding means are also provided for pivotably mounting the outer member 25 of the boom onto the other carrier 37 about a second axis "B" perpendicular to the longitudinal axis of the boom. These holding means include a sleeve 45 in which the outer member 25 of the boom 21 is slidably mounted.

Figure 4:
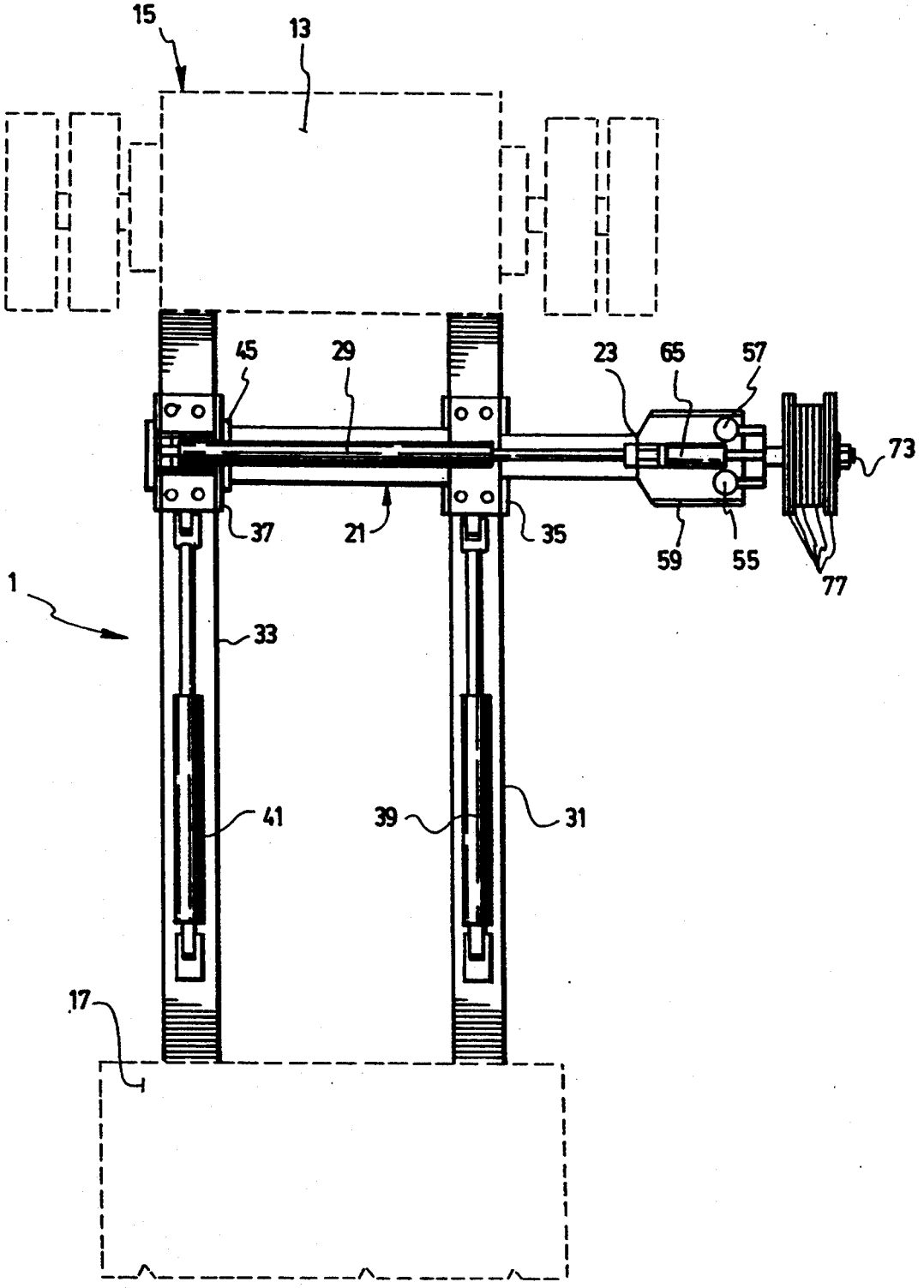
FIG. 4 is a top plan view of the truck platform and machine shown in FIG. 1.
Figure 5:
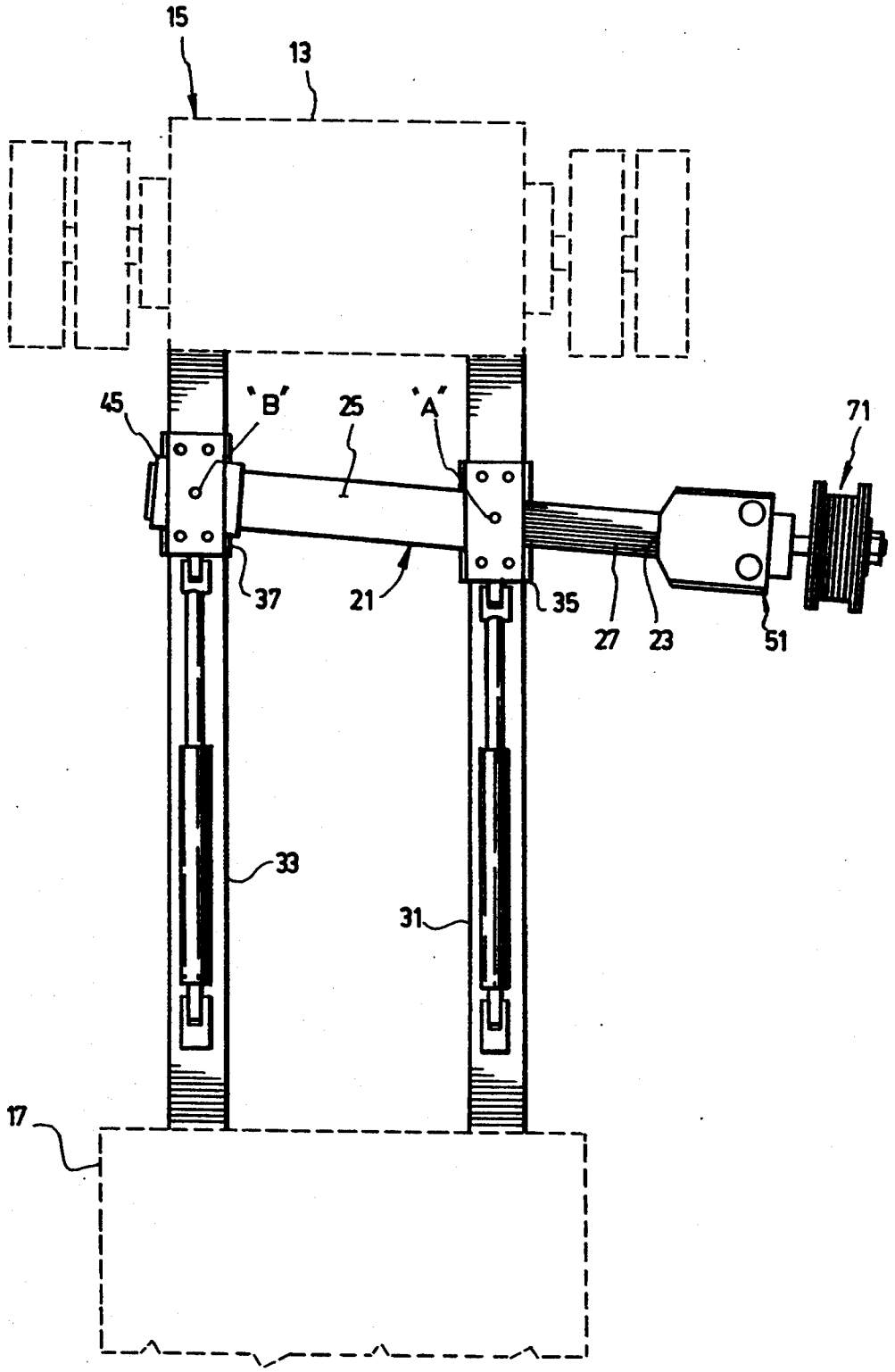
FIG. 5 is a view similar to the one of FIG. 4, showing the boom of the machine oriented at a different angle.

As can now be appreciated, proper adjustment of the first and second carriers 35, 37 along the first and second rails 31, 33 by proper actuation of the cylinders 39, 41, will cause the front end of the outer member 25 of the boom 21 to pivot about the axis "A" of the connecting means 43, and the rear end of this member 25 to pivot and slide in the sleeve 45 about the axis "B" of the holding means, thereby allowing the boom 21 to reach any required transversal orientation with respect to the front-to-rear axis of the vehicle (see FIGS. 4 and 5).

For further information as to the structure of the above described, first mounting means and the way it allows for adjustment of the transversal orientation of the boom 21 with respect to the front-to-rear axis of the vehicle, reference can be made to U.S. Pat. No. 5,230,270 issued on Jul. 27, 1993 to the same inventor, which discloses a machine for cutting concrete barriers, having a transversal boom similarly mounted on a truck platform.

Referring again to FIG. 1, the machine 1 also comprises power jack means 51 having an extensible bottom end 53, which preferably consists of two hydraulic cylinders having housings 55, 57 rigidly connected in parallel relationship and piston rods movable in unison.

Second mounting means are provided for mounting the power jack means 51 on the extensible end 23 of the boom 21 so that, on the one hand, the boom and the power jack means extends in a same vertical plane "P" (see FIG. 2) and, on the other hand, the power jack means is downwardly oriented and has its bottom end 23 downwardly extensible.

As is shown, the second mounting means preferably comprises a set of brackets 59, 60, 61 respectively secured to the lateral sides of the inner member 27 of the boom 21 so as to project longitudinally away from the extensible end 29 of this boom. The brackets 59, 60, 61 are spaced part and positioned so as to receive the power jack means 51 in between and be joined to the same by a pivot pin 63 extending perpendicularly with respect to the boom and the power jack means, respectively.

The second mounting means also comprises means for adjustably tilting the power jack means 51 within the vertical plane "P" about the axis of the pivot pin 63, which is perpendicular to the boom 21. These means include a power cylinder 65 which is preferably hydraulic and has one end 67 pivotably connected to a bracket fixed to the inner member 27 of the boom, and another end 69 pivotably connected to the power jack means 51, away from the pivot pin 63.

Referring again to FIG. 1, the machine 1 further comprises a cutting device 71 mounted at the bottom end of the power jack means 51 so as to come into contact with the roadway surface "S" and to make therein the required cavity when the power jack means 51 is actuated. When the road marker 3 to be installed is like the one shown in FIGS. 8 and 9, the cutting device 71 comprises a shaft 73 extending in the same plane "P' as the boom 21 and the power jack means 51, in a direction substantially perpendicular to this power jack means. The cutting device also comprises power means which is preferably a hydraulically operated motor 75 to drive the shaft 73 in rotation, and a set of circular blades 77 mounted in parallel relationship onto the shaft so as to rotate therewith. Of course, the blades 77 must be sized and positioned so as to cut the required cavity in the roadway surface "S", which, in this particular case, is made of three arcuate recesses, including the two laterally spaced-apart recesses 5', 7' that are sized and positioned to receive the keel-shaped members 5 and 7 and the central recess 9' that is sized and positioned to receive the bracing member 9 of the road marker 3.

For further information as to the structure of such a cutting device 71, reference can be made to U.S. Pat. No. 4,174,184 mentioned hereinabove.

In accordance with the invention, first control means are provided for allowing an operator who is preferably the driver of the truck seated in the cabin 17, to ascertain that the cutting device 71 is properly oriented relative to the roadway surface "S" prior to making the required cavity.

Figure 2:
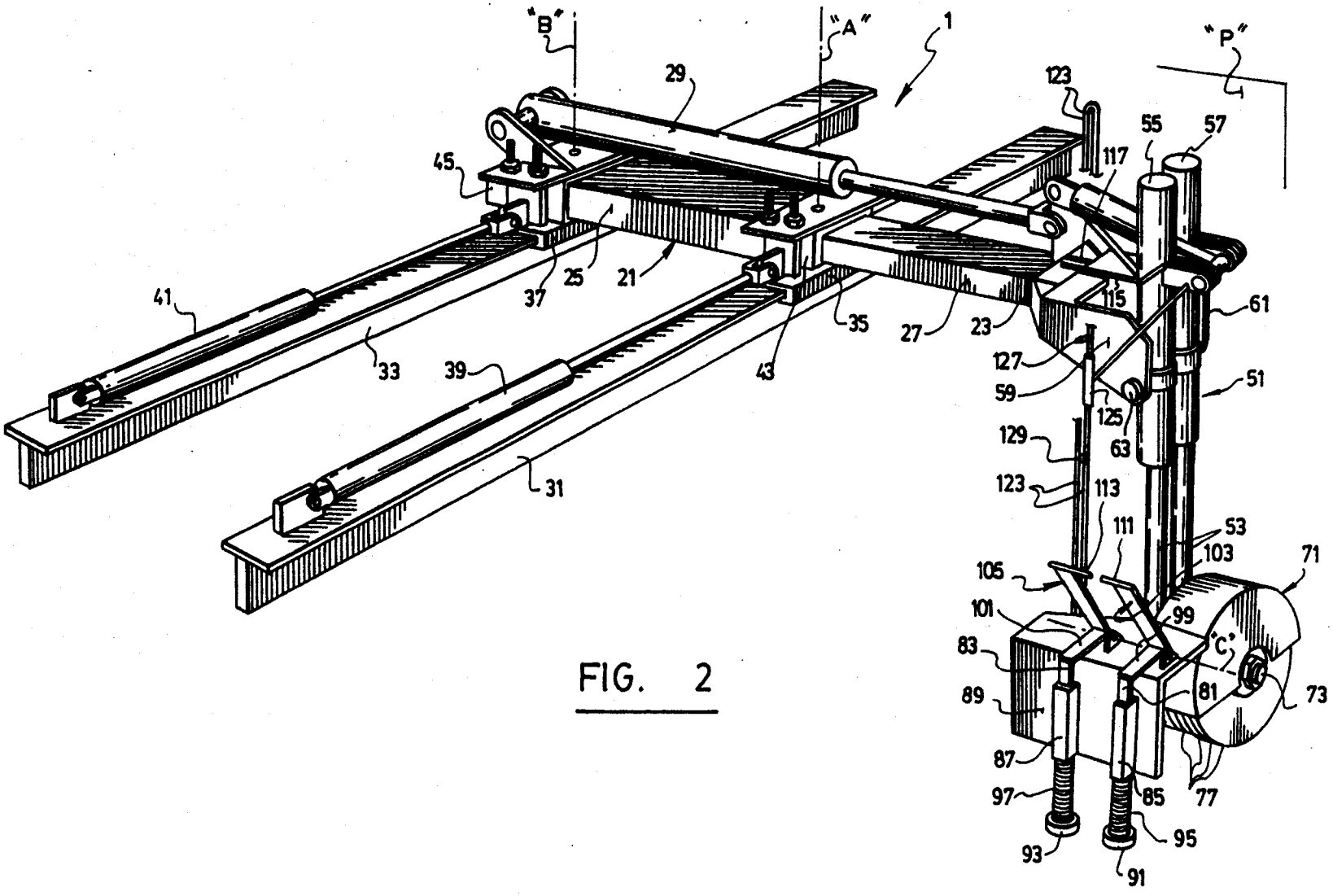
FIG. 2 is a perspective view of the main components of the machine shown in FIG. 1.
Figure 3:
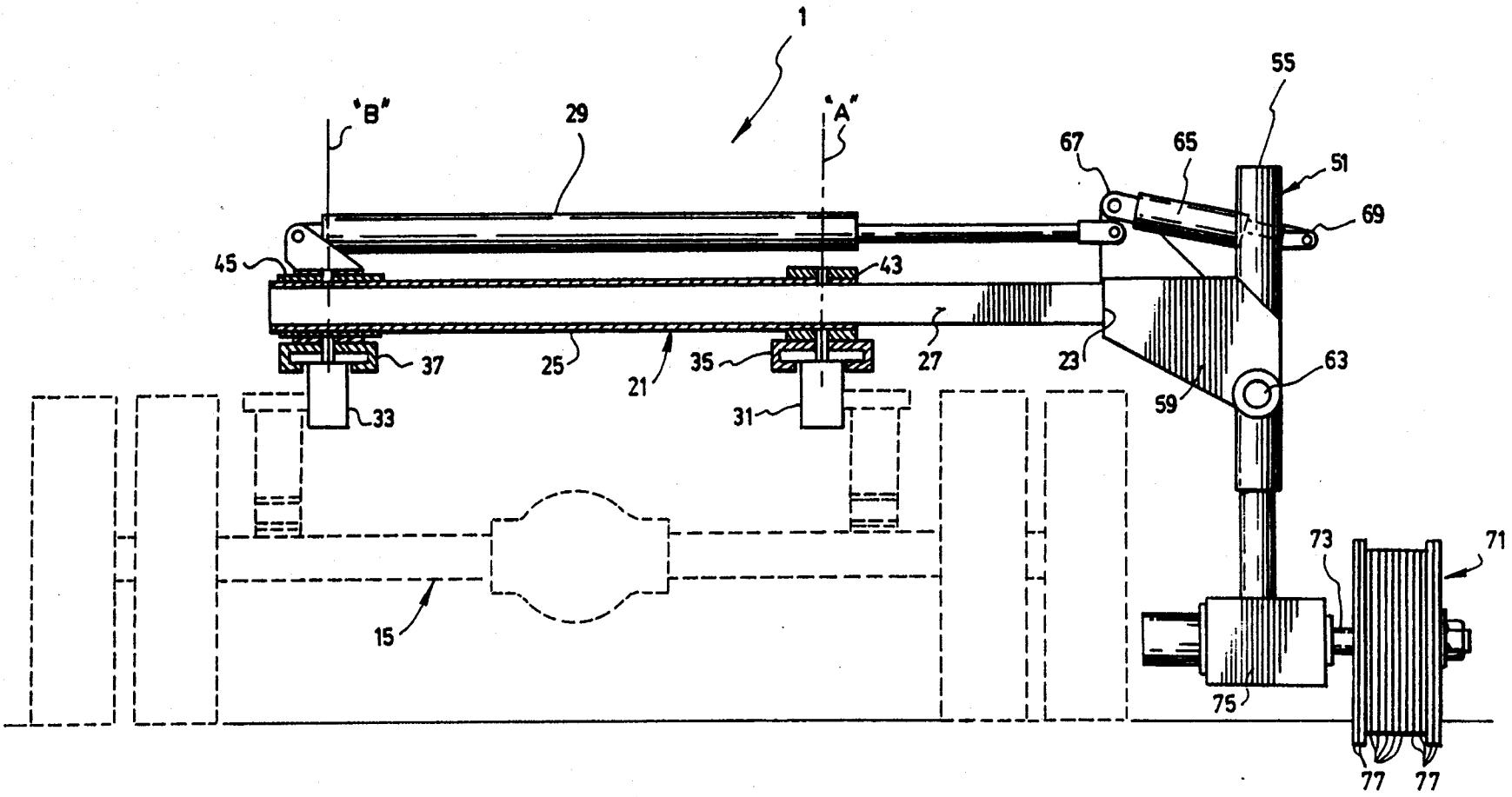
FIG. 3 is a cross-sectional rear view of the truck platform and machine shown in FIG. 1.
Figure 6:
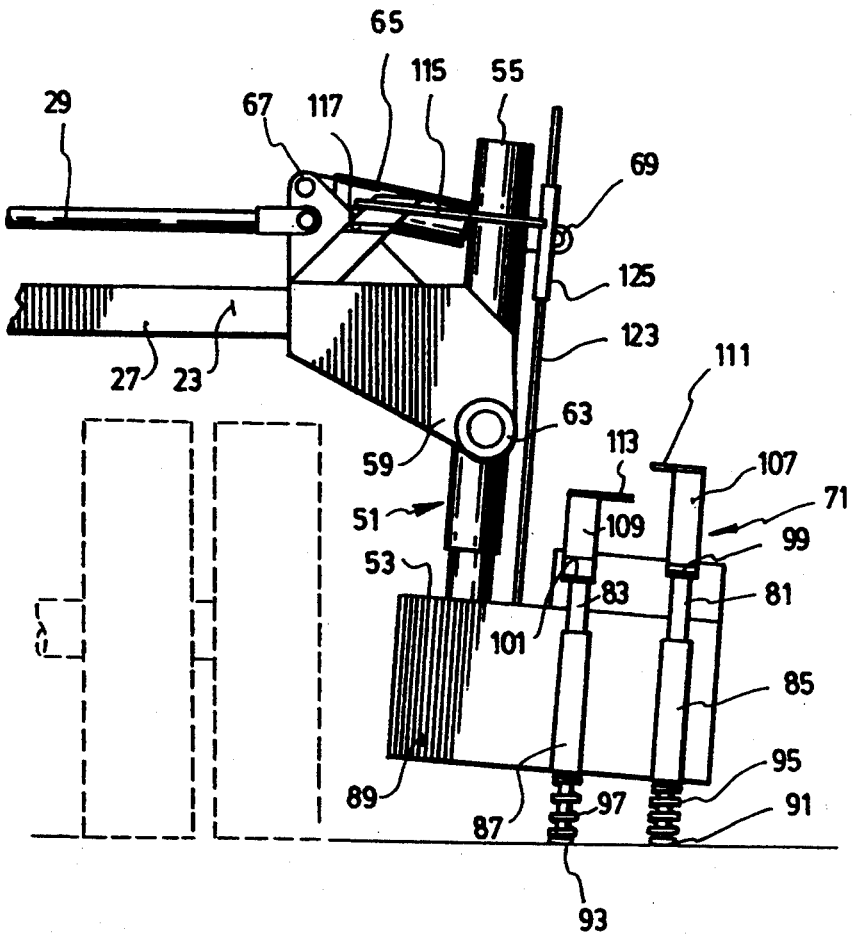
FIG. 6 is a side elevational view of the boom, power jack means and cutting device of the machine of FIGS. 1 to 5 showing these elements in a different angular position as compared to FIG. 3.
Figure 7:
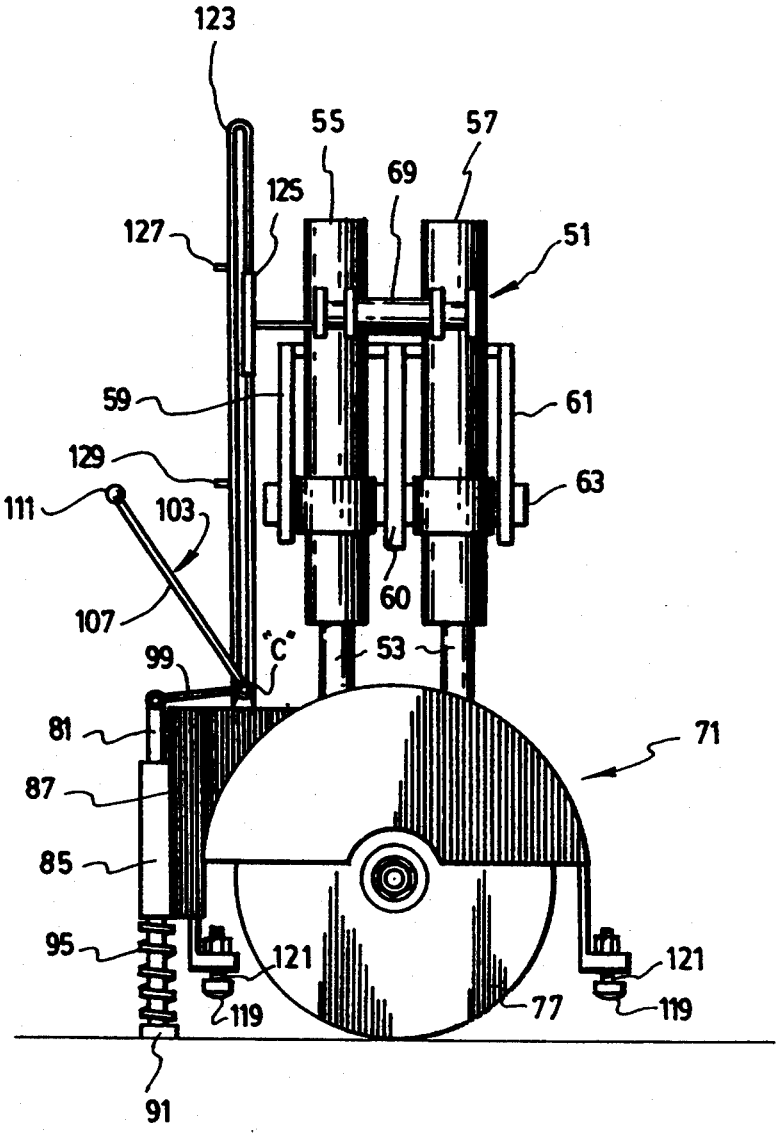
FIG. 7 is a front elevational view of the power jack means, cutting device and control means of the machine of FIGS. 1 to 6.

As is better shown in FIGS. 2, 6 and 7, the first control means preferably comprises a pair of identical legs 81, 83 slidably mounted in parallel relationship in a pair of sleeves 85, 87 connected to a support 89 which can be part of the hood of the cutting device and is secured to the extensible bottom end 53 of the power jack means 51. The legs extend parallel to the power jack means 51 in a plane parallel to the boom 21 and have their feet 91,93 positioned to contact the roadway surface before or at the very same time as the cutting device 71 when the power jack means is actuated. The legs 81, 83 also have upper ends devised to give a visible indication to the operator that they extend at the same level and that, accordingly, the adjacent cutting device 71 is properly levelled relative to the roadway surface "S". As can be seen, the feet 91, 93 of the legs are preferably biased downwardly by means of springs 95, 97.

To make this visible indication of a proper levelling more easily observable from the cabin 17 of the truck and thus to prevent the operator from having to step out of the truck to ascertain that the required levelling has been achieved, the upper end of each leg 81, 83 is preferably positioned to bear under one arm 99, 101 of an L-shaped member 103, 105 pivotably connected to the support 89 about an axis "C" parallel to the longitudinal axis. Each L-shaped member 103, 105 has another, upwardly extending arm 107, 109 with an upper free end shaped to define a horizontal mark 111, 113. As can be appreciated, the mark 111 of the leg 81, which is visible from far away, will be aligned with the mark 113 of the other leg 83 as soon as the cutting device 71 is properly levelled. The use of such members 103, 105 whose arms are of different lengths permits to "increase" the variation in height of the upper ends of the legs and thus to make this variation easier to observe from the cabin of the truck.

To make the levelling even faster in places when the roadway surface is flat and the boom 21 already extends horizontally relative to this surface "S", the first control means may simply consist of visible means for ascertaining that the power jack means 51 is in a position perpendicular to the boom 21. As is shown in FIGS. 2 and 6, these visual means may include a pin 115 rigidly connected to the power jack means 51 so as to extend towards and parallel to the boom 21 and a mark 117 made onto the boom 21 so as to face and be aligned with the pin 115 when the power jack means 51 and the pin 115 are tilted and have reached the position where the power jack means 51 is perpendicular to the boom 21. Once again, such means are easily observable from the cabin of the truck, thereby making unnecessary for the driver to get out to check.

Last of all, in accordance with the invention, second control means are provided for controlling the depth of penetration of the cutting device 71 and thus the depth of the cavity while the same is being made. These second control means are shown in FIG. 7. They preferably consist of a plurality of steps 119 mounted onto the support 87 fixed to the extensible bottom end 53 of the power jack means 51 so as to contact the roadway surface "S" when the cavity is fully cut. Preferably each step 119 is mounted at the bottom end of a bolt 1 21 that is adjustable in height to adjust the depth of penetration to the required value and take into account the wear of the circular blades 77.

In order to speed up as much as possible the sequence of steps to be carried out to make a given cavity, third control means may further be provided for rapidly ascertaining the position of the cutting device 71 relative to the roadway surface "S". Referring to FIGS. 1, 2, 6 and 7, these third control means preferably comprise an inverted U-shaped rod 123 projecting upwardly from the support 87 of the legs in a direction parallel to the power jack means 51. A sleeve 125 rigidly connected to the power jack means 51 away from the extensible bottom end 53 of the same, is slidably engaged on one of the arms of the rod 123.

Marks 127, 129 are provided on the other arms of the rod for giving a visual indication of the longitudinal position of the rod and associated support 89 relative to the sleeve 125 and thus of the cutting device 71 relative to the roadway surface "S".

This makes it possible for the operator to actuate the power jack means 51 to move very fast the cutting device 71 down to a position where its levelling can be adjusted, and thus to move it more slowly while the hydraulic motor 75 is actuated to cut the recesses 5', 7' and 9' in the roadway surface "S".

As can now be understood, the machine 1 is used as follows.

The operator who is also the driver of the truck 15, drives the same onto the road or highway where the road markers 3 must be installed. At each selected location which can previously be marked on the roadway surface, the truck stops and the operator actuates the hydraulic cylinders 39, 41, 29, 55 and 57 to bring as fast as possible the cutting device 71 to the selected location. To do so, use can be made of the third control means 123, 125 disclosed hereinabove. Then, the operator levels the cutting device 71, using any one or both of the first control means disclosed hereinabove, before actuating the hydraulic motor 75 and power jack means 51 to make the required cavity. All of these steps can be easily controlled from the driver's cabin window.

As soon as the cavity is made, the truck can move to a subsequent location and performs again the same sequence of steps, while another worker installs the road marker 3 in the cavity that was so made.

Numerous modifications can be made to the machine described hereinabove without departing from the scope of the present invention as defined in the appended claims. Thus, for example, the road marker to be installed could be of a structure completely different from the one shown in FIGS. 8 and 9. In such a case, only the structure of the cutting device 71 would have to be changed, the other structural elements of the machine remaining identical. Similarly, other kinds of control means could be used to ascertain that the cutting device 71 is properly levelled, such as electronic levelling devices that would give a signal to the operator as soon as the cutting device is levelled.

I claim:

1. A machine for making a cavity in a roadway surface so as to install a road marker, said machine being mounted on a support base forming part of a powered vehicle having a front-to-rear axis and comprising:

a) a lengthwise-extensible boom having a longitudinal axis and an extensible end;

b) first mounting means for mounting the boom on the support base, said boom extending substantially horizontally in a direction transversal to said front-to-rear axis;

c) power jack means having an extensible bottom end;

d) second mounting means for mounting the power jack means on the extensible end of the boom so that, on the one hand, said boom and said power jack means extend in a same vertical plane and, on the other hand, said power jack means is downwardly oriented and has its bottom end downwardly extensible, said second mounting means including means for adjustably tilting the power jack means within said vertical plane about an axis perpendicular to the boom;

e) a cutting device mounted at the bottom end of the power jack means so as to come into contact with the roadway surface and to make therein the required cavity when said power jack means is actuated;

f) first control means for ascertaining that the cutting device is properly oriented relative to the roadway surface prior to making the required cavity; and g second control means for controlling the depth of penetration of the cutting device and thus the depth of said cavity when the same is being made said second control means consisting of at least one step operatively associated to the extensible bottom end of the power jack means so as to contact the roadway surface and prevent said extensible bottom end and the cutting device mounted on it from further moving down into said surface as soon as the cavity is completed, wherein the boom is telescopic and includes:

an outer member connected to said first mounting means;

an inner member slidably mounted within said outer member; and a power cylinder to adjustably move the inner member with respect to the outer member; and wherein said first mounting means comprises:

first and second guiding rails rigidly fixed to the base support, said first and second rails being spaced apart and extending parallel to said front-to-rear axis of the vehicle;

first and second boom carriers slidably mounted on said first and second rails, respectively;

first and second driving means to move said first and second carriers along said first and second rails, independently from each other;

connecting means for pivotably connecting the other member onto one of said first and second carriers about a fist axis perpendicular to the longitudinal axis of said boom; and holding means including a sleeve in which the outer member of said boom is slidably mounted, said holding means being pivotably mounted onto the other one of said first and second carriers about a second axis perpendicular to said longitudinal axis;

whereby proper adjustment of said first and second carriers along said first and second rails by proper actuation of said first and second driving means, respectively, causes the boom to pivot about the first axis of the connecting means and to reach any required transversal orientation with respect to the front-to-rear axis of the vehicle.

2. The machine of claim 1, wherein said first and second driving means consist of hydraulic cylinders.

3. The machine of claim 1, wherein:

said second mounting means includes a pivot pin connecting the inner member of the boom adjacent the extensible end thereof to said power jack means, said pivot pin extending perpendicularly with respect to both of said boom and said power jack means; and said means for adjustably tilting the power jack means includes a power cylinder having ends pivotably connected to the inner member of the boom and to said power jack means away from said pivot pin, respectively.

4. The machine of claim 3, wherein said second mounting means further includes a pair of brackets respectively secured to the lateral sides of the inner member of the boom so as to project longitudinally away from the extensible end of said boom, said brackets being spaced part and positioned so as to receive said power jack means in between and be joined to the same by said pivot pin.

5. The machine of claim 1, for use to install a road marker type comprising two elongated keel-shaped members laterally spaced apart and adapted to be respectively disposed and secured in a pair of complementary recesses made in the roadway surface, the marker also comprising a bracing member interconnecting the keel-shaped members and supporting signal means devised and positioned to be visible from oncoming vehicles moving on said roadway surface, wherein said cutting device comprises:

a shaft extending in the same plane as the boom and the power jack means in a direction substantially perpendicular to said power jack means;

power means to drive said shaft in rotation; and a set of saws mounted in parallel relationship onto the shaft so as to rotate therewith, said saws being sized and positioned so as to cut three arcuate recesses when the cutting device is operated, including two laterally spaced-apart recesses sized and positioned to receive the keel-shaped members and a central recess sized and positioned to receive the bracing member of the road marker, said three recesses forming said cavity to be made in the roadway surface.

6. A machine for making a cavity in a roadway surface so as to install a road marker, said machine being mounted on a support base forming part of a powered vehicle having a front-to-rear axis and comprising:

a) a lengthwise-extensible boom having a longitudinal axis and an extensible end;

b) first mounting means for mounting the boom on the support base, said boom extending substantially horizontally in a direction transversal to said front-to-rear axis;

c) power jack means having an extensible bottom end;

d) second mounting means for mounting the power jack means on the extensible end of the boom so that, on the one hand, said boom and said power jack means extend in a same vertical plane and, on the other hand, said power jack means is downwardly oriented and has its bottom end downwardly extensible, said second mounting means including means for adjustably tilting the power jack means within said vertical plane about an axis perpendicular to the boom;

e) a cutting device mounted at the bottom end of the power jack means so as to come into contact with the roadway surface and to make therein the required cavity when said power jack means is actuated;

f) first control means for ascertaining that the cutting device is properly oriented relative to the roadway surface prior to making the required cavity; and g) second control means for controlling the depth of penetration of the cutting device and thus the depth of said cavity when the same is being made said second control means consisting of at least one step operatively associated to the extensible bottom end of the power jack means so as to contact the roadway surface and prevent said extensible bottom end and the cutting device mounted on it from further moving down into said surface as soon as the cavity is completed, wherein said first control means comprises visible means for ascertaining that the power jack means is in a position perpendicular to the boom, said visible means including a pin rigidly connected to the power jack means so as to extend towards and parallel to the boom, and a mark made onto the boom so as to face and be aligned with the pin when the power jack means and its pin are tilted and have reached the position where the power jack means is perpendicular to the boom.

7. The machine of claim 6, wherein said first mounting means also includes means for adjusting the transversal orientation of the boom with respect to the front-to-rear axis of the vehicle.

8. A machine for making a cavity in a roadway surface so as to install a road marker, said machine being mounted on a support base forming part of a powered vehicle having a front-to-rear axis and comprising:

a) a lengthwise-extensible boom having a longitudinal axis and an extensible end;

b) first mounting means for mounting the boom on the support base, said boom extending substantially horizontally in a direction transversal to said front-to-rear axis;

c) power jack means having an extensible bottom end;

d) second mounting means for mounting the power jack means on the extensible end of the boom so that, on the one hand, said boom and said power jack means extend in a same vertical plane and, on the other hand, said power jack means is downwardly oriented and has its bottom end downwardly extensible, said second mounting means including means for adjustably tilting the power jack means within said vertical plane about an axis perpendicular to the boom;

e) a cutting device mounted at the bottom end of the power jack means so as to come into contact with the roadway surface and to make therein the required cavity when said power jack means is actuated;

f) first control means for ascertaining that the cutting device is properly oriented relative to the roadway surface prior to making the required cavity; and g) second control means for controlling the depth of penetration of the cutting device and thus the depth of said cavity when the same is being made said second control means consisting of at least one step operatively associated to the extensible bottom end of the power jack means so as to contact the roadway surface and prevent said extensible bottom end and the cutting device mounted on it from further moving down into said surface as soon as the cavity is completed, wherein said first control means comprises a pair of identical legs slidably mounted in parallel relationship onto a support secured to the extensible bottom end of the power jack means, said legs extending parallel to said power jack means in a plane parallel to said boom and having feet positioned to contact the roadway surface before or at the very same time as the cutting device when the power jack means is actuated, said legs also having upper ends devised to give a visual indication to an operator that they extend at the same level and that, accordingly, the adjacent cutting device is properly levelled relative to the roadway surface.

9. The machine of claim 8, wherein each of said legs is mounted within a sleeve connected to the support and has its foot spring-biased downwards and its upper end bearing under one arm of an L-shaped member pivotably connected to said support about an axis parallel to said longitudinal axis, said L-shaped member having another, upwardly extending arm with an upper free end shaped to define a horizontal mark which is aligned with the similar mark of the other leg when the cutting device is properly levelled.

10. The machine of claim 9, wherein said second control means comprises a plurality of said at least one stop mounted on said support so as to limit the depth of penetration of said cutting device, each of said stops being adjustable in height to adjust said depth of penetration.

11. The machine of claim 10, wherein said first control means further comprises visible means for ascertaining that the power jack means is in a position perpendicular to the boom, said visible means including a pin rigidly connected to the power jack means so as to extend towards and parallel to the boom, and a mark made onto the boom so as to face and be aligned with the pin when the power jack means and its pin are tilted and have reached the position where the power jack means is perpendicular to the boom.

12. The machine of claim 11, further comprising:

h) third control means for rapidly ascertaining the position of the cutting device relative to the roadway surface, said third control means comprising:

a rod projecting upwardly from the support of said legs in a direction parallel to said power jack means;

a sleeve rigidly connected to the power jack means away from the extensible bottom end of the same and slidably engaged on said rod; and marks on said rod to give a visual indication of the longitudinal position of the rod and associated support relative to said sleeve and thus of said cutting device relative to the roadway surface.

13. The machine of claim 11, wherein the primary boom is telescopic and includes:

an outer member connected to said first mounting means;

an inner member slidably mounted within said outer member; and a power cylinder to adjustably move the inner member with respect to the outer member.

14. The machine of claim 13, wherein:

said second mounting means includes a pivot pin connecting the inner member of the boom adjacent the extensible end thereof to said power jack means, said pivot pin extending perpendicularly with respect to both of said boom and said power jack means; and said means for adjustably tilting the power jack means includes a power cylinder having ends pivotably connected to the inner member of the boom and to said power jack means away from said pivot pin, respectively.

15. The machine of claim 14, wherein said power jack means consists of two hydraulic cylinders having housings rigidly connected in parallel relationship and piston rods movable in unison.

16. The machine of claim 14, for use to install a road marker of the type comprising two elongated keel-shaped members laterally spaced apart and adapted to be respectively disposed and secured in a pair of complementary recesses made in the roadway surface, the marker also comprising a bracing member interconnecting the keel-shaped members and supporting signal means devised and positioned to be visible from oncoming vehicles moving on said roadway surface, wherein said cutting device comprises:

a shaft extending in the same plane as the boom and the power jack means in a direction substantially perpendicular to said power jack means;

power means to drive said shaft in rotation; and a set of saws mounted in parallel relationship onto the shaft so as to rotate therewith, said saws being sized and positioned so as to cut three arcuate recesses when the cutting device is operated, including two laterally spaced-apart recesses sized and positioned to receive the keel-shaped members and a central recess sized and positioned to receive the bracing member of the road marker, said three recesses forming said cavity to be made in the roadway surface.

17. The machine of claim 16, further comprising:

h) third control means for rapidly ascertaining the position of the cutting device relative to the roadway surface, said third control means comprising:

a rod projecting upwardly form the support of said legs in a direction parallel to said power jack means;

a sleeve rigidly connected to the power jack means away from the extensible bottom end of the same and slidably engaged on said rod; and marks on said rod to give a visual indication of the longitudinal position of the rod and associated support relative to said sleeve and thus of said cutting device relative to the roadway surface.

18. The machine of claim 10, for use to install a road marker of the type comprising two elongated keel-shaped members laterally spaced apart and adapted to be respectively disposed and secured in a pair of complementary recesses made in the roadway surface, the marker also comprising a bracing member interconnecting the keel-shaped members and supporting signal means devised and positioned to be visible from oncoming vehicles moving on said roadway surface, wherein said cutting device comprises:

a shaft extending in the same plane as the boom and the power jack means in a direction substantially perpendicular to said power jack means;

power means to drive said shaft in rotation; and a set of saws mounted in parallel relationship onto the shaft so as to rotate therewith, said saws being sized and positioned so as to cut three arcuate recesses when the cutting device is operated, including two laterally spaced-apart recesses sized and positioned to receive the keel-shaped members and a central recess sized and positioned to receive the bracing member of the road marker, said three recesses forming said cavity to be made in the roadway surface.

* * * * *